United States Patent [19]

Zysset

[11] 3,930,509

[45] Jan. 6, 1976

[54] SMOKERS PIPE REAMER

[75] Inventor: Karl Zysset, Lyss, Switzerland

[73] Assignee: K. Zysset & Co. AG, Lyss, Switzerland

[22] Filed: Apr. 9, 1975

[21] Appl. No.: 566,209

[30] Foreign Application Priority Data

Apr. 10, 1974 Switzerland ..... 5017/74

[52] U.S. Cl. ..... 131/246

[51] Int. Cl.[2] ..... A24F 9/10

[58] Field of Search ..... 131/232, 243, 246

[56] References Cited

UNITED STATES PATENTS

| | | | |
|---|---|---|---|
| 1,611,622 | 12/1926 | White | 131/246 |
| 2,894,515 | 7/1959 | Wismer, Jr. | 131/243 |
| 3,079,932 | 3/1953 | Fassbender | 131/246 |

FOREIGN PATENTS OR APPLICATIONS

| | | | |
|---|---|---|---|
| 1,095,976 | 12/1967 | United Kingdom | 131/246 |

*Primary Examiner*—Joseph S. Reich
*Attorney, Agent, or Firm*—Flynn & Frishauf

[57] ABSTRACT

A smokers' pipe reamer comprises a hollow body, a forward portion of which has three longitudinally extending radial grooves and bearing slots, each extending radially from a respective one of the grooves to the interior. In each of the grooves a reamer blade is guided, this blade having a U-shaped appendage protruding into the interior. Three pins held in the forward portion of the body extend through the openings of respective ones of the appendages to permit radial and swiveling motion of the respective reamer blades. Radial movement of the blades may be adjusted by a pin having a conical tip adapted to bear against the radially innermost portions of the blade appendages. The pin is adjustable along the longitudinal axis of the reamer body by means of screw threads and a guiding slot, thereby limiting radially inward movement of the appendages and the blades while permitting the blades to swivel about each of the three pins.

2 Claims, 2 Drawing Figures

SMOKERS PIPE REAMER

This invention relates to a smokers' pipe reamer comprising a hollow body having a front portion with an interior space and a rear portion with a rearward end, three radial grooves or slots having parallel axes and being disposed within the front portion at regular intervals from one another, three blades, each guided in a respective groove or slot and having a bearing opening, three bearing parts secured to the body and each passing through a middle portion of the length of a groove or slot and through a bearing opening, and a mechanism accommodated in the body for the bearing adjustment of the blades.

Whenever a tobacco pipe is smoked, charred matter is produced in the pipe bowl. The volume of the bowl is thus decreased. Hence the charred matter must be scraped out from time to time, which is usually done by means of a blade. It often happens that the bowl is then scraped down to the bare wood; this is harmful to the pipe, for if there is not always a thin layer of char on the inside of the bowl, smoking is not so pleasant.

There are a number of reaming tools on the market which are adjustable in diameter. However, they are equipped with only two blades positioned opposite one another, and therefore there is no provision for guiding them within the bowl of the pipe. Accurate guidance of the blades is necessary, however, because otherwise the charred matter cannot be uniformly removed.

British Pat. No. 1,095,976 teaches a pipe reamer in which the blades are mounted rather far towards the front on the hollow body, which is provided with guide slots for them, by means of a circlip passing through a hole in each of them. The conical outside surface or nose near the bottom of a plunger constantly acted upon by a spring presses upon inclines surfaces on the inner edges of the blades in order to pivot the blades away from each other from the back.

The play in the holes of the circlip serving to support the blades has no operational significance, and the inclined surfaces upon which the adjusting part acts are situated at a considerable distance from those holes; the result is a purely pivotal adjustment of the blades about a bearing point which is invariable as regards its distance from the central axis.

In the case of a pipe reamer shown in U.S. Pat. No. 3,079,932, the blades are first mounted at their rearward ends, by means of a notch in each one, on a plug screwed into the reamer housing. A ball cooperating with the adjusting mechanism is provided at a considerable longitudinal distance from that bearing point for each blade. Thus in the case of this known reamer as well, the result is a purely pivotal adjustment of the blades about a bearing which is not adjustable as far as its distance from the central axis of the reamer is concerned.

However, there exists a further necessity, namely, that the blades should be able to adapt their mutual inclination to the conicity of the pipe bowl interior; this conicity is always present but differs in degree from pipe to pipe The point of departure for the present invention was a known pipe reamer such as is disclosed, for example, in the afore-mentioned British Pat. No. 1,095,976 and its object is to provide an improved reamer meeting the requirements set forth above.

To this end, in the smokers' pipe reamer according to the present invention, each blade comprises a U-shaped appendage projecting into the interior space of the body front portion, the adjustment mechanism comprises a part which is longitudinally displaceable within that interior space and which includes a conical surface, each bearing opening takes the form of an elongated hole partially delimited by such a U-shaped appendage and disposed substantially at right angles to the longitudinal axis of the body, and the conical surface is adapted to act upon the mentioned appendages.

Because each bearing opening is an elongated hole, each blade can be adjusted in the region of its bearing opening in a direction perpendicular to the longitudinal axis of the reamer body. Furthermore, since the longitudinally displaceable part of the adjustment mechanism acts upon a U-shaped blade appendage which partially delimits that elongated hole, a. the radial adjustment of the blades takes place in the region of the bearing, and b. free pivotability of each blade is ensured in every position of adjustment.

In other words, once the reamer diameter has been set, each blade is still free to adjust its angle of inclination to whatever the conicity of the particular pipe bowl interior may be.

Inasmuch as both prior disclosures (a) provide a purely pivotal adjustment of the blades about a bearing point situated at a fixed distance from the longitudinal axis of the reamer, and since (b) no possibility of setting the reaming diameter and (c) no possibility of free pivoting of the blades at any setting of the reamer diameter are afforded, or even alluded to, by either of these prior disclosures, the pipe reamer according to the present invention clearly represents an advance in the art.

Moreover, since the prior art in no way suggests a design like that of the invention for which protection is claimed here, neither as regards the object of the invention or the solution provided, and since the characterizing features are by no means simply structural differences but rather—as indicated—form the basis for a considerable advance in the art, they were not obvious to one skilled in the art either.

In a preferred embodiment, the adjusting mechanism is a screw-type adusting mechanism comprising an adjusting knob mounted rotatably and axially immovably on the rearward end of the reamer body and a sliding sleeve non-rotatably guided for longitudinal displacement within the rear portion of that body, and a pin guided in the fromt portion of the body and having a front end exhibiting the previously-mentioned conical surface is secured to the sleeve. The advantage of this design is that a certain reaming diameter can be set and maintained. Hence this design differs clearly and advantageously from those of the prior art, where the (pivotal) adjustment mechanism comprises a spring which continuously urges an adjustment in the one direction. Moreover, neither is this design obvious in view of either of the aforementioned prior disclosures, considered individually or in combination.

Such a preferred embodiment of the invention will now be described in detail with reference to the accompanying drawing, in which.

Figure 2:
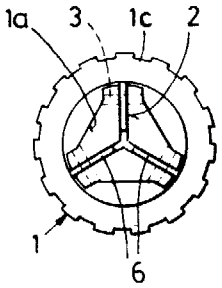
FIG. 2 is an end view of the same reamer with the cap removed.

The smokers' pipe reamer illustrated comprises a one-piece body 1, consisting of a front portion 1*a* having the three-armed polygonal contour visible in FIG. 2, transverse partition 1*b*, and a hollow, cylindrical rear portion 1*c* which is coaxial with and about the same length as the front portion 1*a*.

The front portion 1*a* comprises three radial grooves 2 which have parallel axes and are disposed at regular intervals from one another, each in one of the three arms of the front portion 1*a*. A bearing pin 3 passes through a portion of each groove 2 about midway along its length, at which location each groove 2 communicates via an opening 4 with an interior space 5, for the most part cylindrical, within the front portion 1*a*.

Guided in each of the grooves 2 is a blade 6 having an elongated hole 7 through which one of the bearing pins 3 passes. Each hole 7 is partially delimited by a U-shaped blade appendage 6*a* which projects through the respective opening 4 into the interior space 5 without preventing the blades 6 from pivoting about their bearing pins 3.

The reamer further comprises a mechanism, accommodated for the most part in the rear poriotn 1*c*, for adjusting the blades 6. This adjusting mechanism in turn comprises a pin 8, longitudinally displaceable within the interior space 5 and having a conically tapering front end 8*a* which can be caused to act upon the U-shaped blade appendages 6*a* for the purpose of adjusting the blades 6 radially while at the same time leaving them free to pivot about the bearing pins 3.

The adjusting mechanism is a screw-type mechanism of a well-known kind in which an adjusting knob 9 with its collar 9*a* is held in place rotatably but not axially dispalceably inside the rearward end of the rear portion 1*c* by a ring 10. A portion 9*b* of knob 9 has an external thread (not shown) and can be screwed into a sliding sleeve 11 having an internal thread (not shown). The sleeve 11 has a wedge-shaped appendage 11*a* which engages in an inside groove 12 of the rear portion 1*c*, the axes of the sleeve 11, the appendage 11*a*, and the groove 12 being parallel to one another. Thus the sleeve 11 is guided for longitudinal displacement but cannot be rotated; it also has a hollow cylindrical front appendage in which the rearward end portion of the pin 8 is secured.

Next to its transverse partition 1*b*, the body 1 has a short, cylindrical seat for the rearward end of a removable cap 13.

Figure 1:
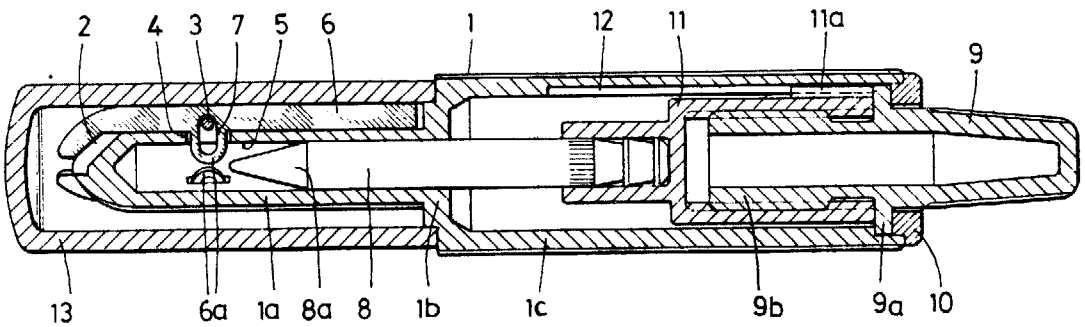
FIG. 1 is a longitudinal section through the pipe reamer.

It will be obvious that when the cap 13 is removed, the pin 8 can be displaced by turning the knob 9 towards the left (FIG. 1); thus the conically tapering end portion 8*a* of the pin 8 comes to act upon the U-shaped appendages 6*a* of the three blades 6 and adjusts them radially towards the outside in the opening 4 while fully maintaining their ability to pivot about their respective bearing pins 3. Thus as the reaming out of carbon deposits in the pipe bowl progresses, the blades 6 may easily be adjusted towards the outside as required, and they will always adapt to the conicity of the pipe bowl interior because they can still pivot freely. Since three blades 6 are provided, the reamer automatically centers itself in the pipe bowl when in use. Thanks to all these properties, charred matter may be scraped out quickly and effortlessly; damage to the pipe bowl may easily be prevented by suitable adjustment of the blades 6.

What is claimed is:

1. A smokers's pipe reamer comprising a hollow body having a front portion with means providing an interior space and a rear portion with a rearward end, means providing three radial grooves having parallel axes and bearing disposed within said front portion and spaced at regular angular intervals, three blades, each guided in a respective groove means and having means providing a bearing opening, three blade bearing parts secured to said body and each passing through a middle portion of the length of a said groove means and through a said bearing opening means, and a mechanism accommodated in said body for the bearing adjustment of said blades, wherein each said blade comprises a U-shaped appendage projecting into said interior space means, said mechanism comprises a part which is longitudinally displaceable within said interior space means and which includes a conical surface, each said bearing opening means takes the form of an elongated hole partially delimited by a said appendage and disposed substanially at right angles to the longitudinal axis of said body, and said conical surface being adapted to act upon said appendages.

2. A reamer in accordance with claim 1, wherein said mechanism is a screw-type adjusting mechanism comprising an adjusting knob mounted rotatably and axially immovably on said rearward end and a sliding sleeve non-rotatably guided for longitudinal displacement within said rear portion, and a pin guided in said front portion and having a front end comprising said conical surface, said pin being secured to said sleeve.

* * * * *